United States Patent [19]

Moser

[11] 4,174,106

[45] Nov. 13, 1979

[54] GAME OF SKILL

[76] Inventor: Willi Moser, Unteres Hardt 6a, 8937 Bad Wörishofen, Fed. Rep. of Germany

[21] Appl. No.: 846,210

[22] Filed: Oct. 27, 1977

[30] Foreign Application Priority Data

Oct. 29, 1976 [DE] Fed. Rep. of Germany ..... 2649381

[51] Int. Cl.[2] ..... A63F 9/14

[52] U.S. Cl. ..... 273/1 E; 35/11 R

[58] Field of Search ..... 273/1 E, 1 M, 86 B; 46/240, 253; 35/11 R

[56] References Cited

U.S. PATENT DOCUMENTS

| | | | |
|---|---|---|---|
| 1,640,259 | 8/1927 | Vallat | 272/2 X |
| 1,712,550 | 5/1929 | Chaussier | 272/76 UX |
| 2,519,472 | 8/1950 | Howard | 46/253 |
| 2,857,710 | 10/1958 | Brown | 46/253 X |
| 3,013,344 | 12/1961 | Simjian | 35/11 R |
| 3,119,190 | 1/1964 | Cafulli et al. | 35/11 R |
| 3,151,865 | 10/1964 | Faure et al. | 273/1 E |
| 3,581,668 | 6/1971 | Ingels | 46/253 X |
| 3,626,635 | 12/1971 | Birdsall | 46/240 |
| 3,657,457 | 4/1972 | Poynter | 273/86 B X |

FOREIGN PATENT DOCUMENTS

| | | | |
|---|---|---|---|
| 1063505 | 8/1959 | Fed. Rep. of Germany | 46/240 |
| 669167 | 3/1952 | United Kingdom | 46/240 |
| 674801 | 7/1952 | United Kingdom | 46/240 |

*Primary Examiner*—Paul E. Shapiro

*Attorney, Agent, or Firm*—Holman & Stern

[57] ABSTRACT

A game of skill involving the remotely-controlled propulsion or guidance of a toy vehicle through a pictorial model representation of a hazardous journey or path. When the objective is successfully reached the vehicle operates a switch to trigger a camera which photographs the operator at the control site.

8 Claims, 3 Drawing Figures

GAME OF SKILL

This invention relates to a game of skill which uses a remotely controlled toy or model automobile. Existing games of skill are know in various forms. Those which use remotely controlled toy or model automobiles enjoy particular popularity because they enable traffic conditions to be simulated.

The object of the present invention is the further development of a game of skill of the kind set forth in such a way as to enhance the simulation or imitation of actuality. A further object is to present an arrangement by which the person operating the game will appear more involved graphically in the simulated situation which therefore will become more stimulating.

In pursuance of these objects, the game of this invention comprises a remotely controlled toy or model vehicle, for example an automobile, movable along a path of travel having limited boundaries, a central command unit, an arrangement for remotely controlling the operation of said vehicle, and a photographic device disposed for taking a picture of a person operating said remote control arrangement, said path of travel having in the vicinity of its end part a switch contact which is operable by said vehicle to trigger said photographic device.

As will be set out hereafter the game according to this invention can be devised to embrace various media and forms of environment. It is therefore for convenience only that one specific example will be described below, with the foregoing proviso. The chosen example is that of an automobile vehicle travelling along a roadway. Using a game of skill in accordance with this invention it is possible to simulate the travel of an automobile vehicle in a path in which obstacles have to be avoided. At the end of the travel of this path the apparatus will take a photograph which shows the operating person actually in action at this point in time.

The enjoyable effect thereby obtained is considerable. This can be increased by appropriate construction of the obstacles, the path of travel or roadway, the toy or model automobile and the associated operating devices. Thus for example the roadway may have an inclination so that the spped of the vehicle varies during the journey. For example moreover the inclination can be variable in places along the roadway, for example it may become increasingly steeper so that the speed of the vehicle increases. Driving conditions of this character allow for most surprising effects in the game to stimulate the skill of the operator.

In accordance with a modification of the invention the obstacles are provided with contacts to produce a signal which may for example terminate the game. The obstacles may however be so constituted as merely to hinder the travel, in which case a time limit to the length of play will be advantageous.

The end of the roadway or path of travel may be the objective. It is advantageous to provide the end of the roadway with a garage or drive-in and it will be apparent that the limits of the drive-in or the like, may present a particularly difficult restriction.

The remote control arrangement may include a steering wheel which can have the conventional dimensions of an automobile steering wheel to enhance the final picture.

Different variations are possible in the driving of the toy or model automobile. The latter may for example have a built-in motor, or it may be operable from the exterior, for instance by a magnetic draw arrangement or by providing the path of travel or roadway with appropriate inclinations.

In a suitable form of the invention use is made of a restoring device in the form of a winch from which a draw cable is pulled off by the toy or model automobile, and winch operated to draw the vehicle back to its starting position, for a new game, in completely automatic fashion when for example the contact at the end of the path of travel is operated or when one of the obstacles or a specific obstacle is struck by the vehicle. The draw cable referred to may also for example incorporate a control cable and an electrical current cable for the driving motor.

Further effects can be achieved if the speed of the vehicle is automatically varied during the travel, be it with a controlled or with an entirely irregular variation. Variations of the speed of travel of this nature can for example be achieved by using a cable unwinding and winding up drum for propelling the vehicle. In the case of a relatively short length of travel, which is here envisaged, an operation of this character is easily accomplished. Variation of the diameter of the winch will give a correspondingly variable rate of travel.

A very simple robust type of construction can be used for the control itself. Advisable is a control mechanism which in substance has only end positions, because this will enable the game effect to be increased. The control can for example be operated by electromagnets in the toy or model automobile and these again can be operated by the remote control arrangement in the vicinity of the steering wheel. In a modification however an influence on the vehicle by devices beneath the path of travel is feasible, for example using electromagnets or other means. Again it will be apparent that control by electromagnetic waves may also be used. In view of the relatively minor remoteness involved, controls of the kind set forth above are as a rule preferable.

Two embodiments of the invention are diagrammatically illustrated in the accompanying drawings in which.

Figure 1:
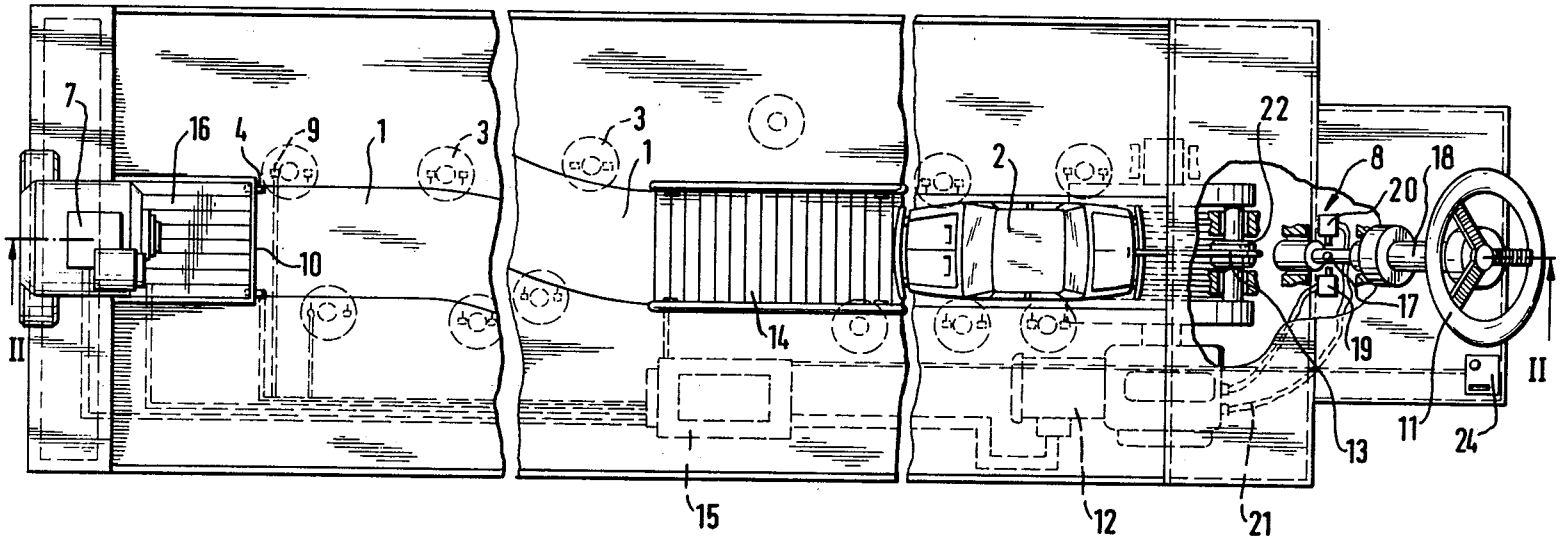
FIG. 1 is a plan view of a first game in accordance with the invention.

The games of skill illustrated in the accompanying drawings are each in the form of a constructional unit comprising a simulated roadway 1, a photographic device 7 and a remote control arrangement 8. In variations of the invention these individual parts can be separate from one another and not combined in one constructional unit, whilst still within the scope of the invention.

The roadway can have various obstacles and hazards, as for example a bridge 14 to be driven over, trees 3, or restrictions 4 to the drive-in. It will be understood that the obstacles referred to are given only as examples and can readily be varied within wide limits.

Figure 2:
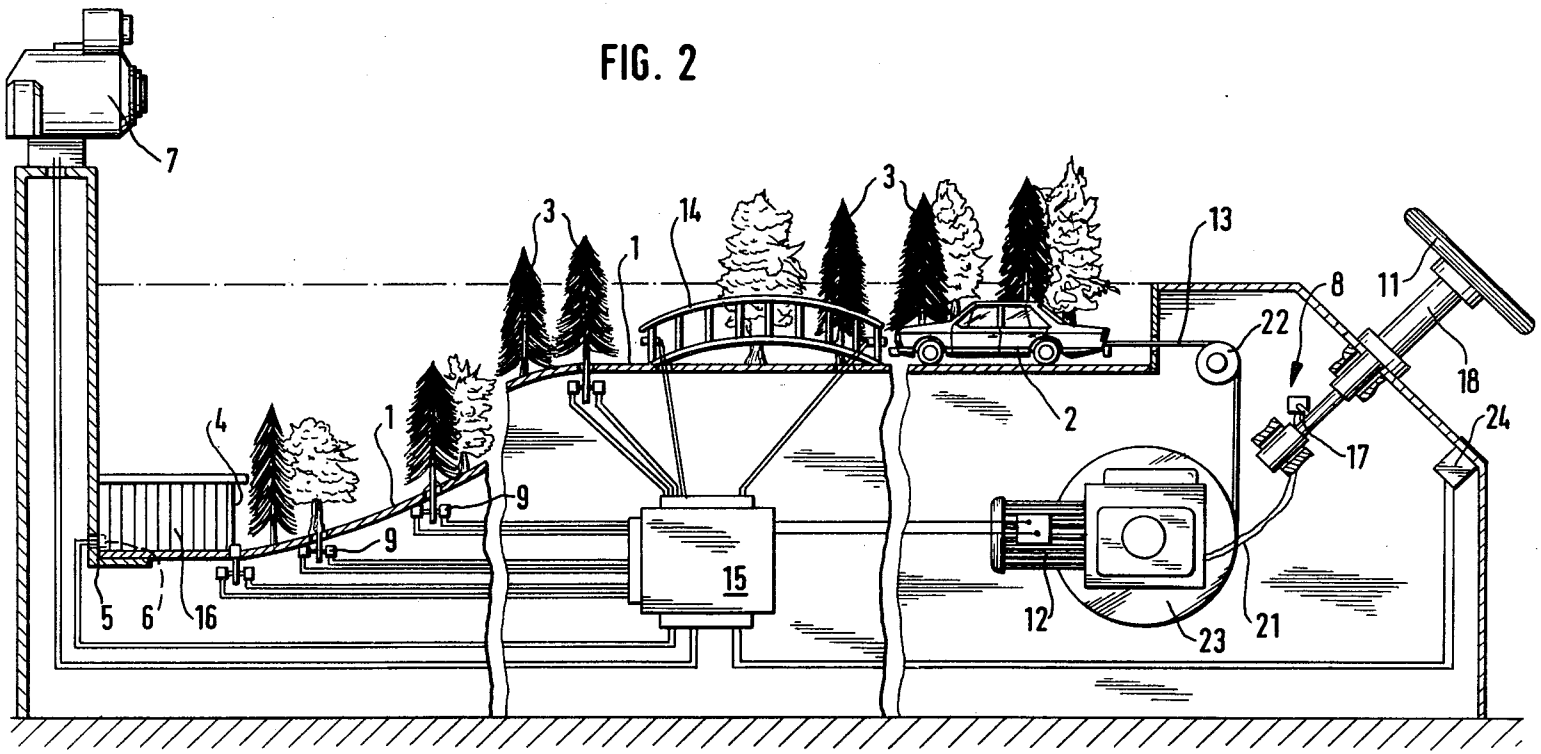
FIG. 2 is a side view of the game with part in section on the line II—II of FIG. 1.

In the embodiment illustrated in FIGS. 1 and 2 the obstacles are associated with contacts 9 in the form of switches, for example microswitches, and all of these are connected to a common command unit 15. Depending on the plan of play of the game it may be arranged that in the event of contact being made with an obstacle the game is terminated, and it may be that the game can then only be continued by a new start. In other variations the travel can continue with loss of points. Various program programmes of play are possible.

The ultimate objective of the automobile 2 is in this example a garage 16. At the end of its travel it will operate a contact 6 to trigger the photographic device 7 through the command unit 15. This photographic device is aimed at the steering wheel 11 which is connected with the remote control arrangement 8.

In the diagrammatic example illustrated in FIGS. 1 and 2 the remote control arrangement is shown as comprising a contact pin 17 on the steering column 18 of the steering wheel 11. This contact pin 17 is adapted to operate one or other of two switches; 9 and 20 which are connected through conduits 21 to the model automobile 2.

To enable the vehicle 2 to be returned to its starting position it is connected to a winching drum 23 by a tow rope 13 which passes over roller 22. The drum is operated by a reversible motor 12 through a clutch (not shown). The tow rope 13 may for example incorporate conduits 21 and also an electrical connecting cable to a driving motor (not shown) of the model automobile 2. This automobile 2 may have appropriate control devices including a steering wheel which can be operatively connected to the steering wheel 11.

At the beginning of a game the apparatus is started by a switching device 24 which may for example be coin operated, which puts the driving motor of the model automobile 2 into operation. The automobile travels along the roadway 1 and is steered at the steering wheel 11. When the end of the roadway 5 behind the drive-in 10 is reached, contact 6 is operated and a photograph is taken showing the operating person at the moment that the objective has been reached. This photographic device may be an instant photograph camera.

The arrangement of this invention can be modified in very many ways. Thus for example the remote control arrangement may be provided with a brake or other similar means. Again it is possible so to control the driving means of the automobile 2 remotely that it can be driven at different speeds.

In yet another variation the vehicle could be moved by external forces, for example draw magnet beneath the path of travel. Again electromagnets could be provided in the model automobile vehicle to define end positions in the control operation.

Figure 3:
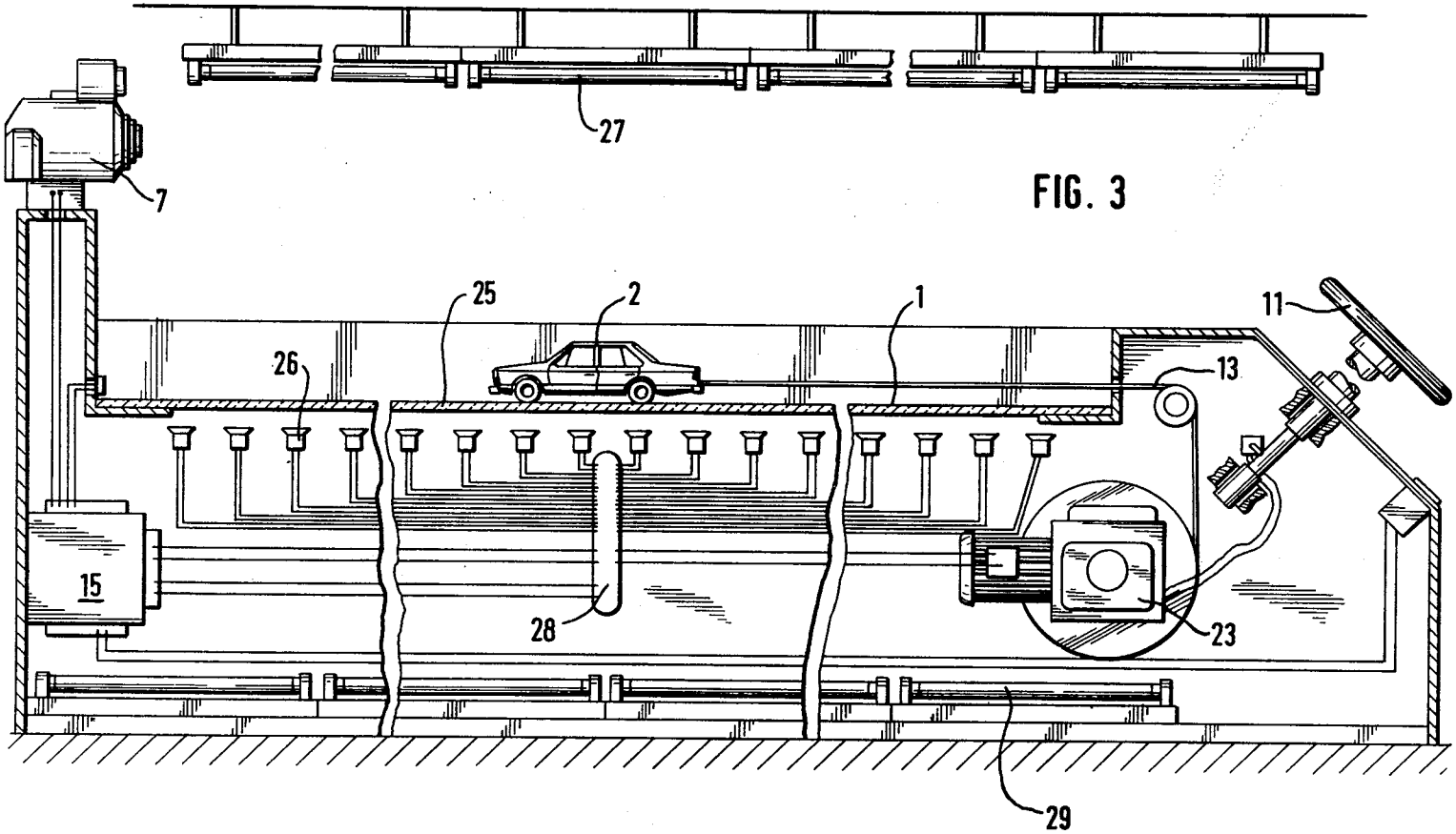
FIG. 3 is a similar side view of another embodiment of the invention.

FIG. 3 shows another embodiment of the invention. In this case the model automobile 2 moves on a roadway 1 constituted by a transparent plate 25. Instead of using the obstacles in the arrangement illustrated in FIGS. 1 and 2, the boundaries of the roadway are defined by photoelectric cells 26 arranged beneath plate 25, the photoelectric cells in each case being arranged at the two sides of the prescribed path of the model automobile 2. Light sources, for example fluorescent lamps 27 are arranged above the automobile 2. Beneath the transparent plate 25 which for example may be of glass, there are further light sources 29 which illuminate the roadway from below.

If the model automobile 2 strays from the prescribed path, it interrupts the illumination of the photoelectric cells to produce a signal. All the photoelectric cells are connected to the collector 28 which is in turn connected to the command unit 15. The signals from the photoelectric cells 26 can have the same effect as the signals put out by the contact 9 in the embodiment described above in connection with FIGS. 1 and 2.

In general the implementation of the invention with a toy or model automobile is thought to give the best simulation. Instead of using a toy or model automobile however a simulated motorboat, aircraft, or for example even an animal, can be used.

The game of skill of the present invention is particularly envisaged for display purposes, but is not limited to such use. By appropriate construction and simplification it may even constitute a family game.

I claim:

1. A game of skill comprising a remotely controlled toy or model vehicle, for example an automobile, movable along a path of travel having limited boundaries, a central command unit, an arrangement for remotely controlling the operation of said vehicle, and a photographic device disposed for taking a picture of a person operating said remote control arrangement, said path of travel having in the vicinity of its end part a switch contact which is operable by said vehicle to trigger said photographic device, wherein said path of travel is constituted by a transparent plate and photoelectrical cells are disposed beneath said plate in positions defining the boundary of the path of permitted travel and are connected to said command unit, light sources being disposed above the plate and said path of travel, whereby an operating signal will be produced at said command unit in response to trespass of said vehicle from the prescribed path of travel.

2. A game according to claim 1, in which the path of travel involves a slope the inclination of which is variable along the length of said path.

3. A game according to claim 1, further including hazards along said path of travel, said remote control arrangement including a steering wheel for directing the travel of said vehicle in avoidance of these hazards.

4. A game according to claim 3, in which said hazards are physical obstacles with electrical contacts connected to said command unit.

5. A game according to claim 3, in which said vehicle has a built-in driving motor operatively connected to said remote control arrangement.

6. A game according to claim 5, in which said driving motor is a variable speed motor.

7. A game according to claim 1, further including magnetic draw means for propelling said vehicle along the path of travel.

8. A game according to claim 1, further including a reversing winch operatively connected to said command unit and having a tow rope physically connected to said vehicle for returning it to a starting position.

* * * * *